US006898922B2

(12) United States Patent
Reist

(10) Patent No.: US 6,898,922 B2
(45) Date of Patent: May 31, 2005

(54) METHOD AND DEVICE FOR THE PACKAGING OF FLAT OBJECTS

(75) Inventor: Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/719,877

(22) Filed: Nov. 21, 2003

(65) Prior Publication Data

US 2004/0104526 A1 Jun. 3, 2004

(30) Foreign Application Priority Data

Nov. 29, 2002 (CH) ..... 2015/02

(51) Int. Cl.[7] ..... B65B 43/04

(52) U.S. Cl. ..... 53/455; 53/452; 53/547; 493/194; 493/249; 270/52.19

(58) Field of Search ..... 270/39.04, 52.19, 270/52.2, 52.22, 52.3; 271/202, 204; 493/193, 194, 196, 199, 201, 249; 53/450, 452, 453, 455, 545, 547, 548

(56) References Cited

U.S. PATENT DOCUMENTS

| | | | | | |
|---|---|---|---|---|---|
| 3,122,362 | A | * | 2/1964 | Vollrath et al. | 270/52.19 |
| 3,951,399 | A | | 4/1976 | Reist | |
| 4,586,703 | A | | 5/1986 | McAnelly | |
| 4,709,910 | A | | 12/1987 | Honegger | |
| 4,775,136 | A | * | 10/1988 | Petersen | 270/52.2 |
| 4,807,865 | A | | 2/1989 | Kobler et al. | |
| 4,828,242 | A | * | 5/1989 | Kobler et al. | 270/52.19 |
| 4,840,365 | A | * | 6/1989 | Kobler et al. | 270/52.19 |
| 4,871,159 | A | * | 10/1989 | Petersen | 270/52.19 |
| 5,050,851 | A | * | 9/1991 | Eugster | 270/52.22 |
| 5,188,349 | A | * | 2/1993 | Honegger | 270/52.22 |
| 6,672,447 | B2 | * | 1/2004 | Muller | 270/52.19 |

FOREIGN PATENT DOCUMENTS

| | | |
|---|---|---|
| DE | 38 38 985 C1 | 2/1989 |
| EP | 0 588 764 A2 | 8/1993 |
| EP | 1 188 670 A1 | 8/2001 |
| GB | 973639 | 10/1964 |

* cited by examiner

*Primary Examiner*—Louis Huynh
(74) *Attorney, Agent, or Firm*—Rankin, Hill, Porter & Clark LLP

(57) ABSTRACT

Flat objects (10) are packaged with a packaging material (1) that is supplied as a quasi-endless web. The packaging material (1) is gripped at one of its surfaces by gripping elements (6), which are spaced from on another. During conveyance of the packaging material (1) by the gripping elements (6), the distances between the gripping elements (6) are reduced and the packaging material (1) is made to buckle between the gripping elements to one side, forming a string of bags (1'). During further conveyance these bags (1') are charged with the flat objects (10), are severed from the string of bags, and are sealed. The packaging material, which is supplied, with its width aligned essentially horizontally, is gripped from above by the gripping elements (6) and therefore buckles downwards by gravity, and the bags are charged from above. The formation of the string of bags is very simple, and for adjusting the bag depth the only measure needed is a corresponding adjustment of the original distance between the gripping elements (6).

17 Claims, 2 Drawing Sheets

METHOD AND DEVICE FOR THE PACKAGING OF FLAT OBJECTS

BACKGROUND OF THE INVENTION

1. Field of the Invention

The present invention is situated in the field of the packaging technology and concerns a method and a device for packaging of flat objects or of small groups of flat objects with the aid of a packaging material that is supplied as a quasi-endless web. The packaging material is in particular a weldable plastic film or sheet material supplied from a reel.

2. Description of Related Art

A known method for continuously packaging individual printing products or small batches of printing products using a web of a plastic film or sheet material supplied from a reel comprises guiding a product stream, in which the products to be packaged are oriented parallel to the conveying direction and are conveyed behind each other and spaced from each other, between two webs of the packaging material or joining the product stream with one web and then wrapping the web around the products or around the product stream respectively. Then the web or webs of film material are sealed parallel to the conveying direction, and they are sealed and separated in the gaps between the products, i.e. transverse to the conveying direction. Such a method and a device for carrying out the method are described, for example, in the publication EP-1188670.

Packaging methods as mentioned above reach their limits regarding performance in produced packages per time unit relatively soon, because the products are conveyed in parallel to the conveying direction and behind each other, which for a high performance, particularly in the case of products being relatively long in conveying direction, leads to conveying speeds that are not easily achieved.

Higher piece performances at easily achieved conveying speeds are known to be possible if the products are conveyed in a conveying stream in which they are not aligned in parallel to the conveying direction but essentially transverse to it. The publication EP-0588764 (Grapha Holding AG) describes a device that is apparently suitable for packaging products being conveyed in such a manner. The device comprises a processing drum of the kind used, e.g., for inserting supplements into printing products or into folded sheets of packaging material. The plastic web is drawn from a supply point at the drum periphery in a zig-zag motion into the compartments of the drum, which are arranged in succession around the circumference of the drum. The bags thus produced are then charged with products, separated, and sealed, and the completely packaged products are removed from the drum compartments.

In the publication DE-3838985 (MAN) an equivalent device for batch-wise operation is described in more detail. With the aid of this device a plastic film web supplied from a supply reel is spread out in a zig-zag, creating a predetermined number of V-shaped bags, which are open along three edges and in which the products to be packaged are positioned. Then the bags are separated, closed around the product, sealed along the three open edges, and discharged from the device. Not until then another given number of bags are formed and the procedure is repeated. For each bag to be fashioned in one batch an essentially identical part-installation is provided and all device-parts are operated simultaneously.

Particularly from the publication EP-3838985 it is evident how complicated the known devices for packaging flat objects with a packaging material supplied from a reel are, and how many movable and individually controlled parts they have to comprise.

SUMMARY OF THE INVENTION

It is an object of the invention to create a method and a device that serve the continuous packaging of flat objects using a packaging material supplied as a quasi-endless web, wherein method and device according to the invention are to be simpler than corresponding methods and devices according to the state of the art and are, in particular, to permit simple means of adjustment to various formats of the objects to be packaged.

The method according to the invention comprises supplying the packaging material continuously, wherein the width of the quasi-endless web of packaging material is advantageously aligned essentially horizontally. Then the packaging material is gripped from above at regular distances and after gripping the distances between the gripping points are reduced, whereby the packaging material buckles between the gripping points, for example, downwards by gravity (possibly aided by additional measures). Thus, a string of bags is formed with the bags being arranged between the gripping points and being open on three sides and closed on one side. The open bag side opposite the one closed side faces upwards. This string of bags held at the gripping points is conveyed past a charging station where a flat object or an equivalent small group of flat objects is positioned inside each bag of the string of bags. Advantageously, positioning of the objects is aided by gravity, i.e. is carried out from above through the open bag side opposite the one closed bag side. As the charged bags are conveyed further they are separated from the string of bags and are then sealed. For sealing the bags are positioned between sealing elements equipped with, for example, welding jaws that advantageously take over the bags and convey them further.

The method described above can be performed also with gripping of the packaging material for forming the string of bags from below.

Instead of the packaging material being supplied with its width extending essentially horizontally and with the bags being formed essentially by the effect of gravity, the packaging material can also be supplied in any other position and can be made to buckle between the gripping points, in one or the other direction relative to the gripped surface, using any suitable means instead of gravity (e.g., an air current). In such a case, the step of charging the bags needs to be arranged accordingly.

It is also possible to seal, in part at least, the sides of the bags of the string of bags before charging the bags, so that, on charging, the bags are able to guide laterally the objects to be packaged. Using the method according to the invention allows a very simple buffering of the bags prior to charging them with objects to be packaged and/or prior to sealing them.

The device according to the invention comprises the following elements: a supply means for supplying the packaging material; a conveyor system with gripping elements being able to be conveyed at variable distances from each other, for gripping and conveying the packaging material; a charging means for inserting the objects to be packaged into the bags; a severing means for severing the bags from the string of bags; and a sealing means for sealing the bags and advantageously for conveying the bags further.

The gripping elements of the conveying system are designed to grip the packaging material from one of its surfaces without hampering the ensuing shaping of the bags and the charging of the bags with objects to be packaged. The gripping elements are, for example, attached to gripper bars, wherein the gripper bars project beyond the width of the packaging material on both sides, their ends being supported by guide rails running parallel to the longitudinal edges of the packaging material and being driven by suitable means. During the gripping step, the gripping elements may be assisted by supporting elements that are conveyed synchronously with the gripping elements, acting on the packaging material from the other one of its surfaces and guiding the packaging material into the gripping elements before these are closed for gripping.

The means for sealing the bags comprises pairs of sealing elements, which can be brought into an open and a closed position, which are conveyed in succession, and which are equipped with devices, such as welding jaws, for the sealing function. The sealing means is advantageously equipped for taking over from the grippers, the string of bags, or possibly the bags severed from the string of bags, the take-over being affected before or after the steps of charging and severing. For this function, the sealing elements may be equipped with holding elements for holding the packaging material and/or means for holding the lower end of the bags may be provided.

An adjustment of the bag depth to the format of the objects to be packaged only requires adjustment of the distance between the gripping points in which the grippers grip the packaging material, or the distance between the gripping elements on gripping respectively.

BRIEF DESCRIPTION OF THE DRAWINGS

Various exemplary embodiments of method and device according to the invention are described in detail in connection with the following drawings, wherein:

(FIG. 1: viewing direction parallel to the width of the packaging material; FIG. 2: viewing direction perpendicular to the width of the packaging material);

(FIG. 3: viewing direction parallel to the width of the packaging material; FIG. 4: viewing direction perpendicular to the width of the packaging material);

DETAILED DESCRIPTION OF THE PREFERRED EMBODIMENTS

Figure 1:
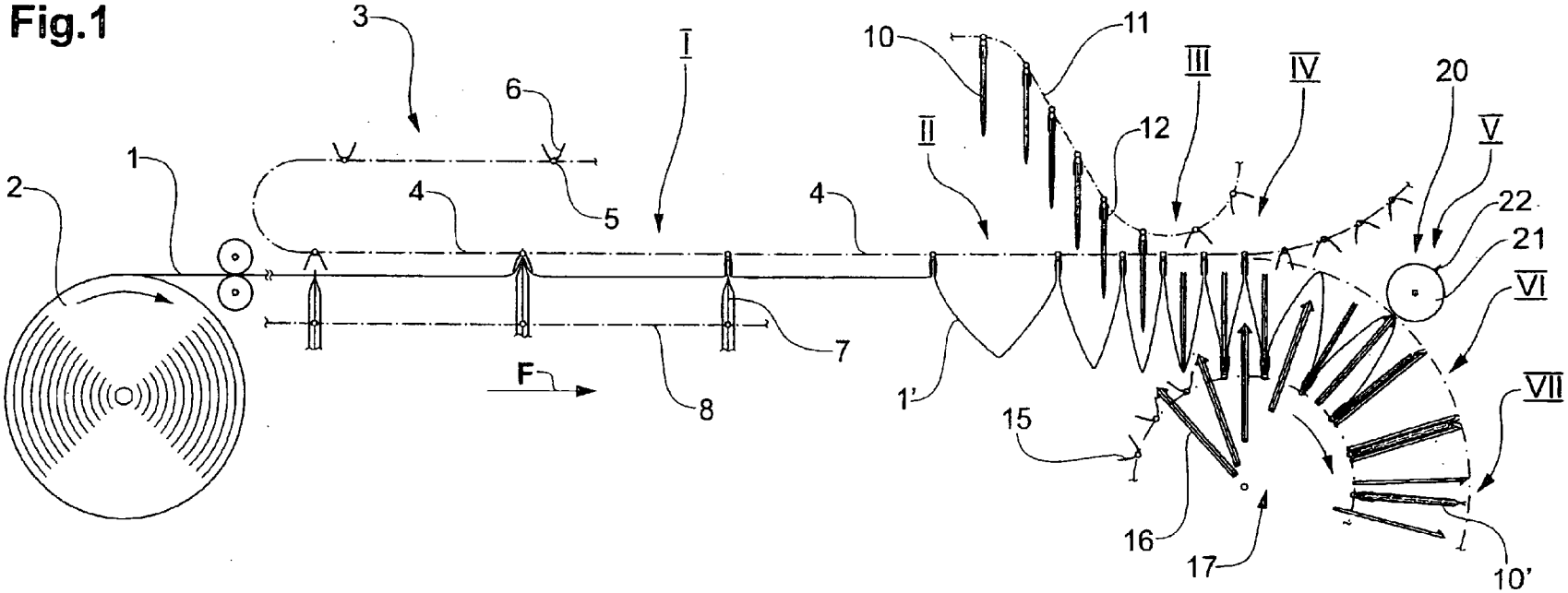
FIGS. 1 and 2 illustrate a first exemplary embodiment of the method according to the invention by showing a schematically-depicted device according to the invention
Figure 2:
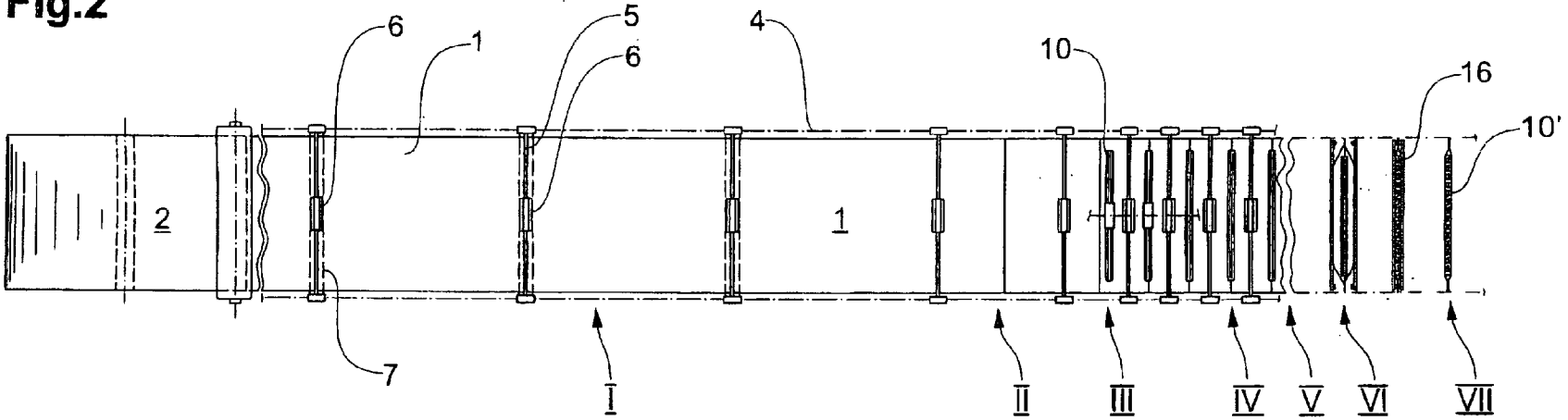

FIGS. 1 and 2 illustrate with a very schematically depicted device a first exemplary embodiment of the method according to the invention. FIG. 1 shows the installation viewed parallel to the width of the packaging material, while FIG. 2 shows the installation viewed vertically to the gripped surface of the packaging material. The general conveying direction (F) runs essentially from left to right in all drawings. The packaging material 1 is supplied from a reel 2 and is then conveyed through a gripping zone I, a bag shaping zone II, a charging point III, a transfer zone IV, a severing point V, a sealing zone VI, and a discharge point VII, at which the completely packaged objects are discharged from the device.

The conveyor system 3, which conveys the packaging material from the gripping zone I to the transfer zone IV, comprises a pair of parallel guide rails 4. Ends of gripper bars 5 are guided in the guide rails 4 and are suitably driven at variable intervals. The gripper bars 5 are carried by rolling or sliding bearings. Gripper elements 6, which cooperate in the gripping zone 1 with the supporting elements 7, are arranged in the middle of the gripper bars 5. The supporting elements 7 are arranged on a circulating conveyor 8. The distance between the supporting elements 7 corresponds with the distance between the gripping elements 6 in the gripping zone 1, or with the length of packaging material to be severed from the quasi-endless web for each package to be produced. Conveyance of the supporting elements 7 is synchronous with the conveyance of the gripping elements 6 so that each supporting element 7 takes up the same position on one side of the packaging material as the co-operating gripping element 6 on the other side of the packaging material. Furthermore, the supporting elements 7 are able to be shifted transverse to their conveying direction, from a first position in which they do not act on the packaging material 1, to a second position in which they reach into the gripping elements. By shifting the supporting elements from the first position into the second position the packaging material is pushed into the co-operating, open gripping element 6.

In the bag shaping zone II the distances between the gripping elements 6 are reduced and the packaging material 1 held between the gripping elements 6 buckles to one side to form bags 1' that all extend to the same side of the gripping elements. Buckling of the packaging material may be assisted actively. The bags 1' are charged with objects 10 to be packaged at the charging point III. The objects 10 to be packaged, which are supplied in a generally known manner by a gripper chain transporter 11, are guided into the bags 1' and then released from the grippers 12 of the gripper chain transporter 11.

In the transfer zone IV downstream of the charging point III, holding elements 15 get hold of the bag side opposite the side gripped by the gripping elements 6 (closed bag side) and two sealing elements 16 are inserted between each two neighbouring bags thus held. As soon as a bag 1' containing an object 10 is sufficiently supported by the holding element 15, and possibly by the sealing elements 16, the bag 1' it is released by the gripping element 6.

At the severing point V each bag 1' is severed from the string of bags by a severing means 20. The severing means 20 is preferably a severing wheel 21 with heating wires or blades 22. The severing means 20 is positioned and driven such that it severs the web of packaging material transversely therein co-operation with the sealing elements 16 inserted between the bags 1'. For the packaging material to maintain its position around the object 10 throughout the process it may be advantageous to equip the distal ends of the sealing elements 16 with securing elements (i.e. rows of needles).

If the gripping elements 6 are appropriately designed, the severing point may be situated upstream of the transfer zone IV, i.e. the bags may be severed from the string of bags while still being held by the gripping elements.

In the sealing zone VI downstream of the severing point V, the two sealing elements 16 being conveyed upstream and downstream of each bag 1' are moved towards each other and are pressed together to seal the packaging material protruding on three sides over the object 10 to be packaged. For sealing, the sealing elements are preferably equipped with welding jaws so that they, when pressed together, weld the appropriate packaging material. It may also be considered to coat the packaging material where the bags are to be sealed with a bonding agent (e.g. adhesive), wherein the bonding agent is activated to seal the layers of packaging material by pressure and/or heat. Sealing the two layers of packaging material by ultrasound or by crimping may also be considered.

In the discharge point VII the sealing elements 16 are separated from each other and the holding elements 15 are opened for discharging the packaged object 10'.

As illustrated, the holding elements 15 and the sealing elements 16 combined with suitable bearing means (not shown) advantageously form a drum-like rotating installation 17, with a rotation axis extending perpendicular to the conveying direction. For controlling the holding elements 15 and the sealing elements 16, stationary control means are to be provided. The holding elements 15 are to be brought into an active configuration, i.e. are to be closed, at a first predetermined position for taking over a bag 1' with an object 10' each, and they are to be brought into a passive configuration, i.e. are to be opened, at a second predetermined position for discharging the packaged objects. The sealing elements 16 are displaced on the one hand in a radial direction for being brought from a passive position into an active position and back. On the other hand, the two sealing elements designated to each bag are to be moved towards each other and pressed together in their active position, to which purpose they are moved in a direction parallel to the circumference of the drum-like installation.

Figure 3:
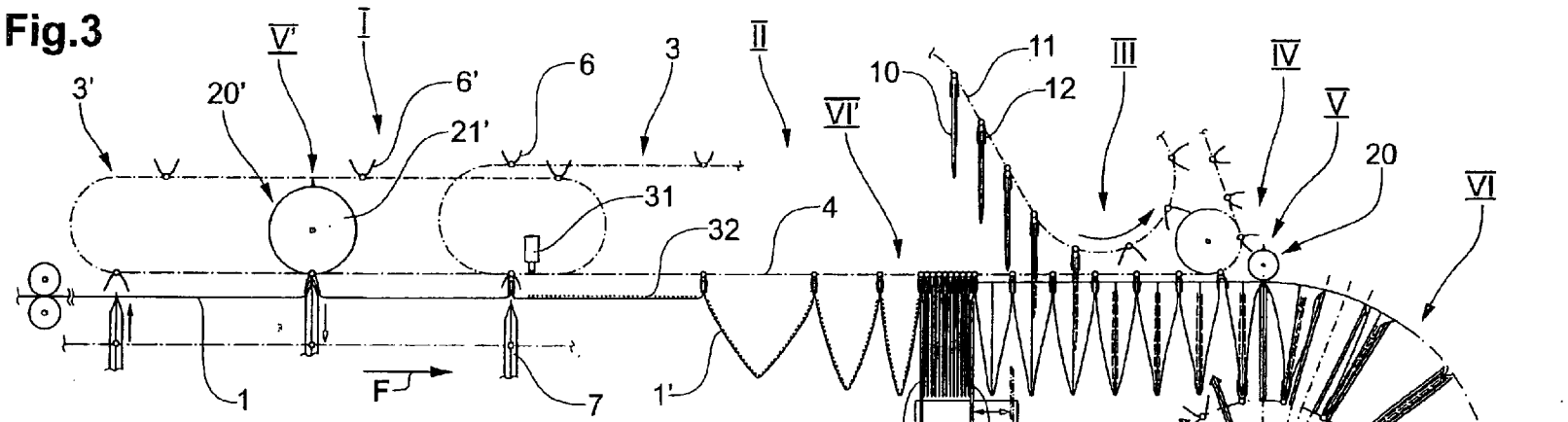
FIGS. 3 and 4 show a further exemplary embodiment of the method according to the invention by showing a schematically-depicted device according to the invention
Figure 4:
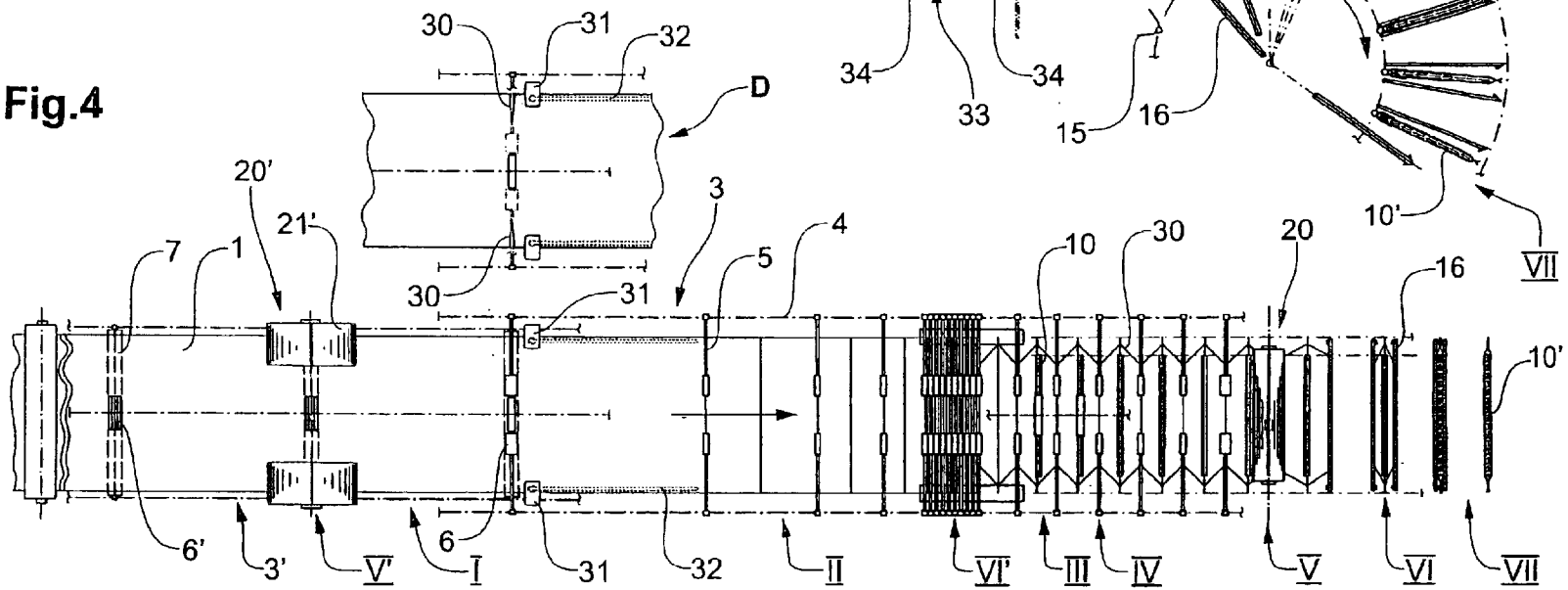

FIGS. 3 and 4 shows in the same very schematic manner as FIGS. 1 and 2 a further embodiment of the device according to the invention, which illustrates a further exemplary embodiment of the method according to the invention. The same elements are designated with same reference numbers as in FIGS. 1 and 2.

The main difference between the embodiment according to FIGS. 1 and 2 and the one according to FIGS. 3 and 4 is that the latter comprises a pre-severing point V' equipped with a pre-severing means 20' and a pre-sealing zone VI' equipped with a pre-sealing means 33. In the pre-severing point V' situated upstream of the severing point V, the bags 1' of the string of bags, or the packaging material respectively, is pre-severed (partly severed). In the pre-sealing zone VI' situated upstream from the sealing zone VI, the bags 1' are sealed along their lateral edges.

Pre-severing the packaging material means cutting only the regions of the packaging material adjacent the longitudinal edges. Pre-severing of the packaging material is necessary for the bags still connected with each other in a string of bags, but already sealed along their lateral edges, to be opened for charging.

For the pre-severing step a pre-severing means 20' comprising two severing wheels 21' situated in the region of the longitudinal edges of the packaging material is provided. The severing wheels 21' co-operate with the supporting elements 7, which extend across the entire width of the packaging material, while pre-gripping elements 6' of a pre-conveyor system 3' arranged above the center of the web of packaging material are responsible for conveyance of the packaging material 1. The packaging material 1 is taken over by the gripping elements 6 downstream of the pre-severing point V', as described in connection with the FIGS. 1 and 2.

The detail D in the FIG. 4 shows the pre-severing 30 performed in the region of the longitudinal edges of the packaging material.

A means 31 for applying a bonding agent to be activated, for example by pressure and/or heat, along the longitudinal edges of the packaging material, i.e. in the region of the lateral seams of the bags, are arranged between the pre-severing point V' and the pre-sealing zone VI'. Advantageously, the applying means 31 is arranged in a region where the gripping elements 6' or 6 still maintain the maximum distance between each other.

In the pre-sealing zone VI' situated between the bag shaping zone II and the charging point III and possibly having a buffering function also, the lateral seams of the bags 1' are produced. The lateral seams are formed, for example, by pressing and/or heating each batch of bags 1' between compression elements 34 arranged in the region of the seams to be produced.

Downstream of the pre-sealing zone VI', the bags, their lateral sides already sealed, are opened for charging by increasing the distances between the gripping elements 6, whereby the pre-severings 30 are splayed.

Charging, severing, and sealing the bags and discharge of the packaged objects 10' proceeds essentially in the same manner as described in connection with FIGS. 1 and 2.

What is claimed is:

1. A method for packaging flat objects (10) with a packaging material (1) comprising a first and a second surface and being supplied as a quasi-endless web, the method comprising the steps of:

forming a string of bags (1') from the packaging material (1) and conveying the string of bags in a conveying direction (F), charging the bags (1') with the objects (10) to be packaged, severing the bags from the string of bags, and sealing the bags, wherein the step of forming comprises gripping the packaging material (1) from the first surface at gripping points spaced from each other by a distance and then reducing the distance between the gripping points and making the packaging material (1) buckle in a same direction between all gripping points.

2. The method according to claim 1, wherein the direction in which the packaging material (1) is made to buckle between the gripping points is oriented away from the second surface.

3. The method according to claim 2, wherein, on forming the string of bags, a width of the packaging material (1) is oriented essentially horizontal, the first surface faces upwards, and wherein the packaging material (1) is made to buckle downwards between the gripping points, and wherein the bags (1') are charged with objects from above.

4. The method according to claim 1, wherein, after charging, the string of bags (1') are transferred to sealing means (16), and are then the string of bags are severed to separate individual bags from the string of bags (1') and then the individual bags are sealed.

5. The method according to claim 1, wherein, prior to charging with an object, the bags (1') of the string of bags are partly severed from each other and sealed along lateral sides.

6. The method according to claim 5, comprising the further step of applying a bonding agent to the packaging material (1) prior to sealing the lateral bag sides.

7. The method according to claim 1, comprising the further step of buffering the bags (1') of the string of bags prior to charging and/or sealing.

8. A device for packaging flat objects (10) with a packaging material (1) comprising a first and a second surface and being supplied as a quasi-endless web, said device comprising:

means for supplying the packaging material (1), a conveying system (3) for forming a string of bags (1') from the packaging material (1) and for conveying the string of bags, means for charging the bags (1') with objects (10) to be packaged, means (20) for severing the bags (1') from the string of bags, and means for sealing the bags (1'), wherein the conveyor system (3) comprises gripping elements (6) that are adapted to be conveyed at variable distances from each other and to grip the packaging material (1) from its first surface, said conveyor system further comprising a first control means for activating the gripping elements and a second control means, arranged downstream of the first control means, for reducing the space between the gripping elements (6).

9. The device according to claim 8, wherein the supply means is adapted to supply the packaging material (1) with an essentially horizontal width, and wherein the gripping elements (6) are arranged for gripping the packaging material (1) from above so that the packaging material (1) buckles downwards by gravity between the gripping elements (6).

10. The device according to claim 8, and further comprising additional supporting elements (7) that are synchronously driven with the gripping elements (6) and equipped for acting on the packaging material (1) from its second surface to drive the packaging material into the gripping elements (6).

11. The device according to claims 8, wherein the gripping elements (6) are arranged on gripper bars (5), wherein ends of the gripper bars (5) are driven and guided in guide rails (4) running alongside the packaging material (1).

12. The device according to claim 8, wherein the sealing means comprises a plurality of sealing elements (16), said sealing elements being adapted for insertion between the bags (1') conveyed by the gripping elements (6), and for closing around the bags (1').

13. The device according to claim 12, wherein the sealing means further comprises a plurality of holding elements (15), said holding elements being adapted for holding the bags (1') at a side opposite the side gripped by the gripping elements (6).

14. The device according to claim 12, wherein at least one of the sealing elements (16) and the holding elements (15) are part of a drum-like installation (17).

15. The device according to claim 8, further comprising a pre-severing means (20') for partly severing the packaging material (1) and a pre-sealing means (33) for sealing lateral sides of the bags (1'), said pre-severing means being arranged upstream of the severing means (20) and said pre-sealing means (33) being arranged upstream of the sealing means.

16. The device according to claim 15, further comprising means (31) for applying a bonding agent to the packaging material.

17. The device according to claim 15, further comprising a pre-conveyor system (3'), said pre-conveyor system being arranged upstream of the conveyor system (3) and comprising pre-gripping elements (6') acting on the packaging material (1) from the same surface as the gripping elements (6) and adapted to grip the packaging material at the gripping points and pass the gripping points on to the gripping elements (6).

* * * * *